US008776741B2

(12) United States Patent
Neal et al.

(10) Patent No.: US 8,776,741 B2
(45) Date of Patent: Jul. 15, 2014

(54) ENGINE ASSEMBLY INCLUDING CAM PHASER ASSEMBLY AID PIN

(75) Inventors: Timothy L. Neal, Ortonville, MI (US); Ronald Jay Pierik, Holly, MI (US); Hong Wai Nguyen, Troy, MI (US); Adrian E. Towns, Davison, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 296 days.

(21) Appl. No.: 13/039,411

(22) Filed: Mar. 3, 2011

(65) Prior Publication Data

US 2012/0222637 A1 Sep. 6, 2012

(51) Int. Cl.

| | |
|---|---|
| ***F01L 1/34*** | (2006.01) |
| ***B23P 19/00*** | (2006.01) |
| ***F01L 1/26*** | (2006.01) |
| ***F01L 1/344*** | (2006.01) |

(52) U.S. Cl.

CPC . *F01L 1/26* (2013.01); *F01L 1/267* (2013.01); *F01L 1/344* (2013.01); *F01L 2103/01* (2013.01)

USPC ..... 123/90.17; 29/275; 29/888.1; 29/888.011

(58) Field of Classification Search

CPC ..... F01L 1/46; F01L 1/047; F01L 2103/01; F01L 1/26; F01L 1/267; F01L 1/344; F02B 77/00; F02B 77/087; B25B 27/0035

USPC ..... 29/275, 888.011; 123/90.1, 90.17

See application file for complete search history.

(56) References Cited

U.S. PATENT DOCUMENTS

| | | | | |
|---|---|---|---|---|
| 2,480,866 | A * | 9/1949 | Lusk | 81/461 |
| 4,619,027 | A * | 10/1986 | Ohannesian | 29/275 |
| 5,099,563 | A * | 3/1992 | Strusch | 29/281.5 |
| 5,845,397 | A * | 12/1998 | Reedy et al. | 29/888.011 |
| 7,287,499 | B2 | 10/2007 | Lawrence et al. | |
| 7,475,663 | B2 * | 1/2009 | Calviti et al. | 123/90.31 |
| 2006/0213045 | A1 * | 9/2006 | Calviti et al. | 29/281.5 |

FOREIGN PATENT DOCUMENTS

| | | |
|---|---|---|
| CN | 1798915 A | 7/2006 |

* cited by examiner

*Primary Examiner* — Kenneth Bomberg
*Assistant Examiner* — Jason T Newton
(74) *Attorney, Agent, or Firm* — Harness, Dickey & Pierce, P.L.C.

(57) ABSTRACT

An engine assembly includes an engine structure, a camshaft supported on the engine structure, a first cam phaser coupled to a first axial end of the camshaft, and a locating pin. The camshaft includes a first shaft, a second shaft, a first cam lobe and a second cam lobe. The first shaft defines a first opening. The second shaft is supported within the first shaft and defines a second opening. The first cam lobe is located on and fixed for rotation with the first shaft. The second cam lobe may be located on the first shaft and fixed for rotation with the second shaft. During assembly, the first cam phaser is located on the camshaft and the locating pin may be inserted through the first and second openings to rotationally fix the first and second shafts. The first cam phaser is then secured to the camshaft.

2 Claims, 5 Drawing Sheets

ENGINE ASSEMBLY INCLUDING CAM PHASER ASSEMBLY AID PIN

FIELD

The present disclosure relates to engine camshaft arrangements.

BACKGROUND

This section provides background information related to the present disclosure which is not necessarily prior art.

Internal combustion engines may combust a mixture of air and fuel in cylinders and thereby produce drive torque. Combustion of the air-fuel mixture produces exhaust gases. Engines may include intake ports to direct and air flow to the combustion chambers and exhaust ports to direct exhaust gases from the combustion chambers. Camshafts are used to displace intake and exhaust valves between open and closed positions to selectively open and close the intake and exhaust valves.

SUMMARY

An engine assembly may include an engine structure, a camshaft supported on the engine structure, a first cam phaser coupled to a first axial end of the camshaft, and a locating pin. The camshaft may include a first shaft, a second shaft, a first cam lobe and a second cam lobe. The first shaft may include an annular wall defining an axial bore and a first opening extending through the annular wall and intersecting the axial bore. The second shaft may be supported for rotation within the first shaft and may define a second opening. The first cam lobe may be located on and fixed for rotation with the first shaft. The second cam lobe may be located on the first shaft and fixed for rotation with the second shaft. During assembly, the first cam phaser may be located on the first axial end of the camshaft and the locating pin may be inserted through the first and second openings and rotationally fix the first shaft relative to the second shaft. The first cam phaser may then be secured to the camshaft.

Further areas of applicability will become apparent from the description provided herein. The description and specific examples in this summary are intended for purposes of illustration only and are not intended to limit the scope of the present disclosure.

BRIEF DESCRIPTION OF THE DRAWINGS

The drawings described herein are for illustrative purposes only and are not intended to limit the scope of the present disclosure in any way.

Corresponding reference numerals indicate corresponding parts throughout the several views of the drawings.

DETAILED DESCRIPTION

Examples of the present disclosure will now be described more fully with reference to the accompanying drawings. The following description is merely exemplary in nature and is not intended to limit the present disclosure, application, or uses.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

When an element or layer is referred to as being "on," "engaged to," "connected to" or "coupled to" another element or layer, it may be directly on, engaged, connected or coupled to the other element or layer, or intervening elements or layers may be present. In contrast, when an element is referred to as being "directly on," "directly engaged to," "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Figure 1:
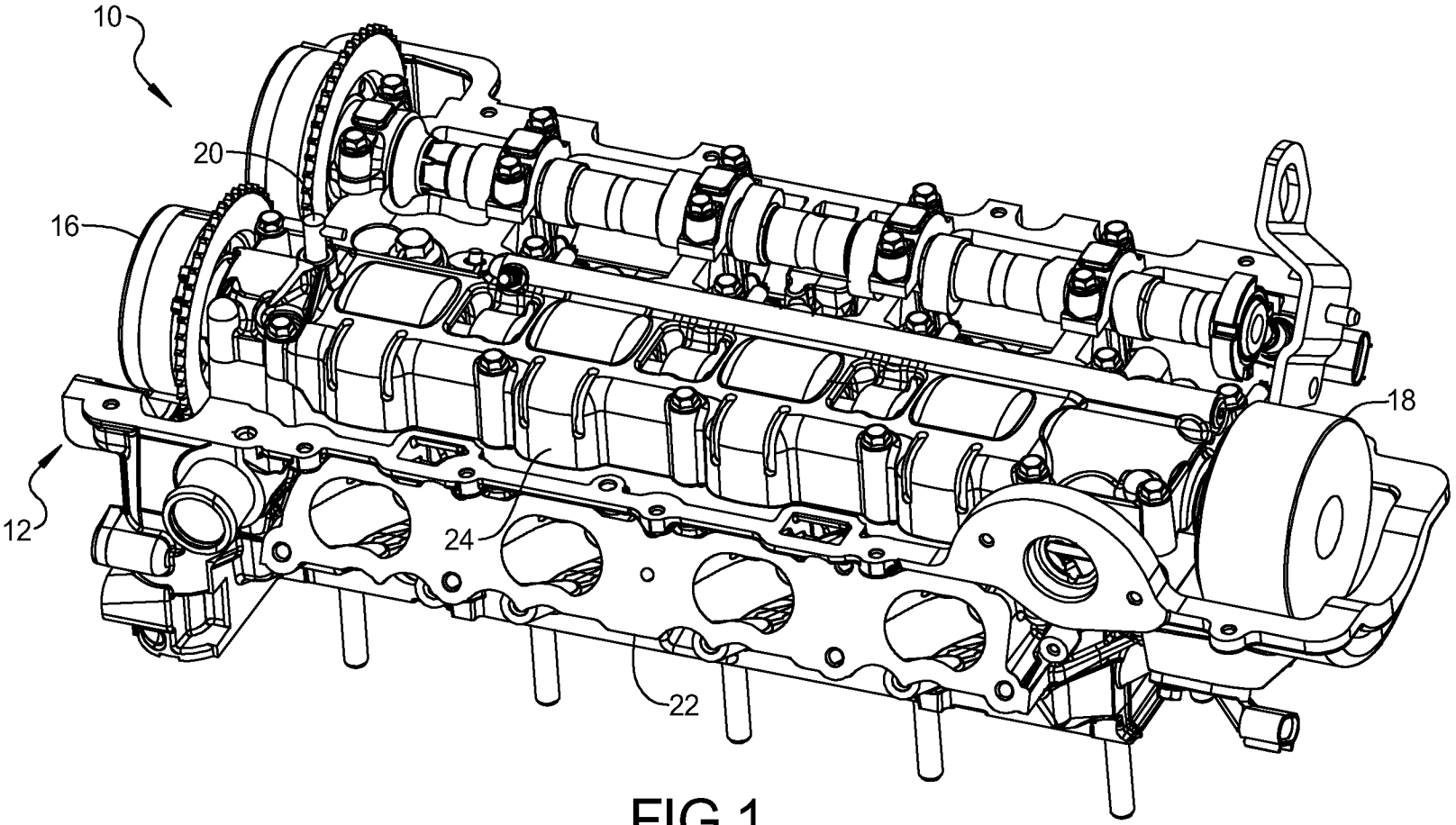
FIG. 1 is a perspective view of an engine assembly according to the present disclosure.
Figure 2:
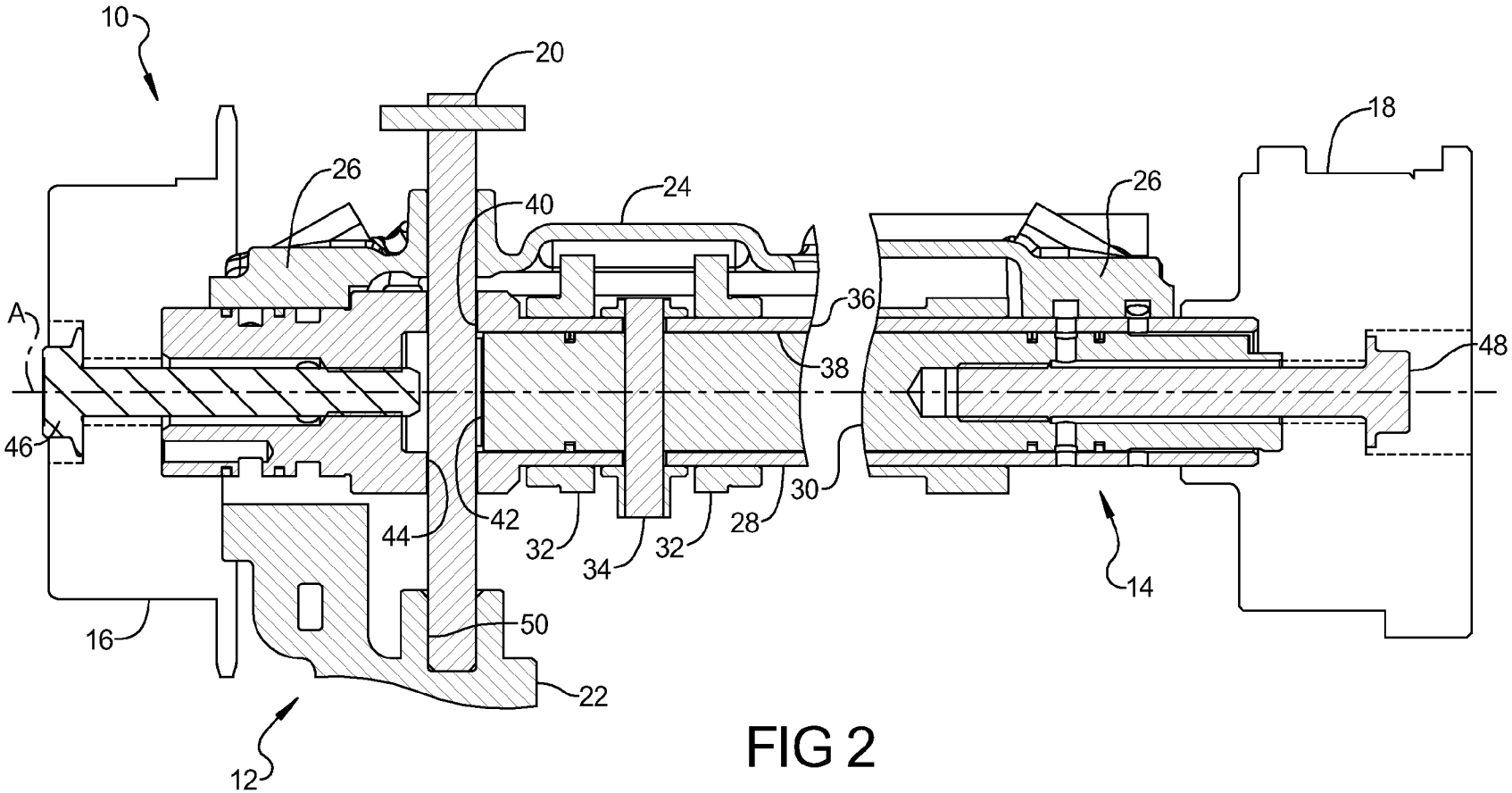
FIG. 2 is a fragmentary section view of the engine assembly shown in FIG. 1.
Figure 3:
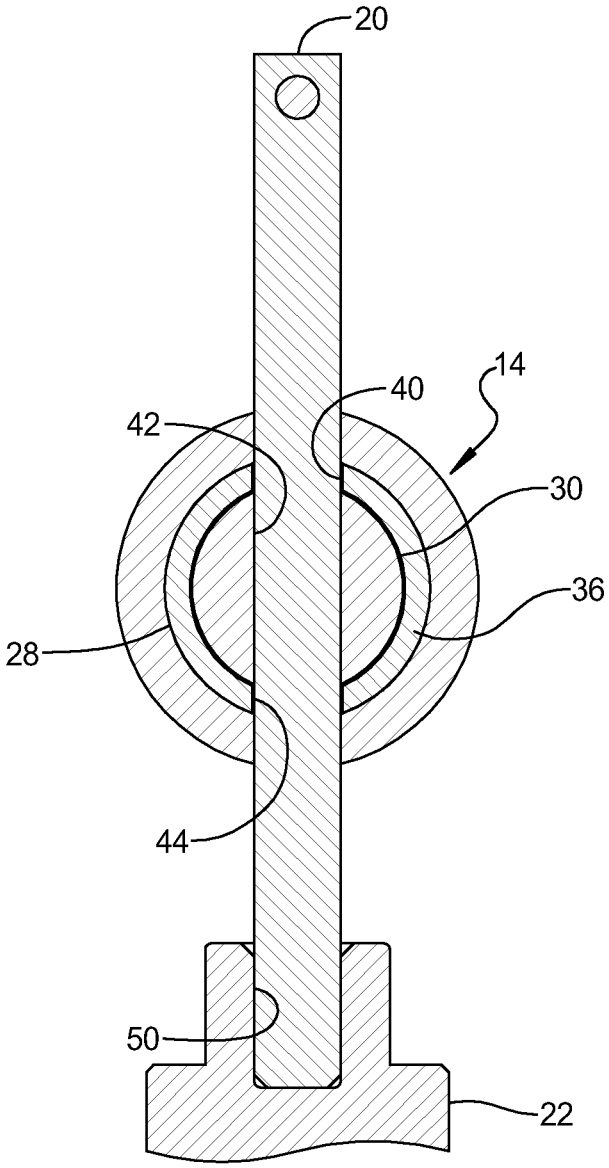
FIG. 3 is an additional fragmentary section view of the engine assembly shown in FIG. 1.

An engine assembly 10 is illustrated in FIGS. 1-3 and may include an engine structure 12, a camshaft 14 supported on the engine structure 12, a first cam phaser 16, a second cam phaser 18 and a locating pin 20. The engine structure 12 may include a cylinder head 22 and a camshaft housing 24 fixed to the cylinder head 22. While illustrated in combination with an overhead cam arrangement, it is understood that the present teachings apply to both overhead cam and cam-in-block configurations. Additionally, it is understood that the present teachings apply to any number of piston-cylinder arrangements and a variety of reciprocating engine configurations including, but not limited to, V-engines, inline engines, and horizontally opposed engines, as well as both gasoline and diesel applications. It is also understood that the present teachings may be applied to transmission components including inner and outer shafts needing angular orientation or restraint during assembly.

The camshaft housing 24 may form a camshaft carrier defining cam bearings 26 rotationally supporting the camshaft 14. In the present non-limiting example, the camshaft 14 includes a first shaft 28, a second shaft 30, first cam lobes 32 and second cam lobes 34. The first shaft 28 may include an annular wall 36 defining an axial bore 38 and a first opening 40 extending through the annular wall 36 and intersecting the axial bore 38. The second shaft 30 may be supported for rotation within the axial bore 38 of the first shaft 28 and may define a second opening 42. In the present non-limiting example, the second opening 42 is formed by a recess located in an axial end of the second shaft 30 defining a radial passage. The first shaft 28 may additionally define a third opening 44 opposite the first opening 40. The first and third openings 40, 44 may each extend radially through the annular wall 36 of the first shaft 28 and perpendicular to a longitudinal axis (A) of the camshaft 14. Similarly, the second opening 42 may extend radially through the second shaft 30 and perpendicular to the longitudinal axis (A) of the camshaft 14. It is understood that the second opening may take a variety of alternate forms including, but not limited to, an opening similar to the openings 40, 44 in the first shaft 28.

The first cam lobes 32 may be located on and fixed for rotation with the first shaft 28. The second cam lobes 34 may be located on the first shaft 28 and fixed for rotation with the second shaft 30. For simplicity, the first and second cam phasers 16, 18 are illustrated schematically in FIG. 2. The first cam phaser 16 may be coupled to a first axial end of the camshaft 14 and the second cam phaser 18 may be coupled to a second axial end of the camshaft 14 opposite the first axial end. More specifically, a first bolt 46 may extend axially through the first cam phaser 16 and secure the first cam phaser 16 to the camshaft 14 and a second bolt 48 may extend axially through the second cam phaser 18 and secure the second cam phaser 18 to the camshaft 14. In the present non-limiting example, the first bolt 46 secures the first cam phaser 16 to the first shaft 28 and the second bolt 48 secures the second cam phaser 18 to the second shaft 30. The second cam phaser 18 may form a camshaft actuator that rotates the second shaft 30 relative to the first shaft 28 to vary valve lift and/or duration.

During assembly, the second opening 42 may be rotationally aligned with the first opening 40 and the third opening 44. The locating pin 20 may extend through the first opening 40, the second opening 42 and the third opening 44 and rotationally fix the first shaft 28 relative to the second shaft 30. The locating pin 20 may additionally be engaged with the engine structure 12 to rotationally secure the first and second shafts 28, 30 relative to the engine structure. In the present non-limiting example, the locating pin 20 extends through the camshaft housing 24 and into an opening 50 defined in the cylinder head 22 and rotationally fixes the first and second shafts 28, 30 relative to the cylinder head 22. The first, second and third openings 40, 42, 44 may be located axially between the first and second bolts 46, 48. Therefore, the locating pin 20 may be inserted into the first and second shafts 28, 30 at a location axially between the first and second bolts 46, 48.

After the locating pin 20 is inserted into the first and second shafts 28, 30 and the engine structure 12, the first cam phaser 16 and the second cam phaser 18 may be secured to the camshaft 14. The first bolt 46 may be inserted axially through the first cam phaser 16 and rotated to secure the first cam phaser 16 to the camshaft 14, and more specifically to the first shaft 28. The second bolt 48 may be inserted axially through the second cam phaser 18 and rotated to secure the second cam phaser 18 to the camshaft 14, and more specifically to the second shaft 30. The locating pin 20 may rotationally fix the first and second shafts 28, 30 relative to one another and relative to the cylinder head 22 during assembly to maintain a predetermined initial rotational orientation of the first and second cam lobes 32, 34 relative to one another.

Figure 4:
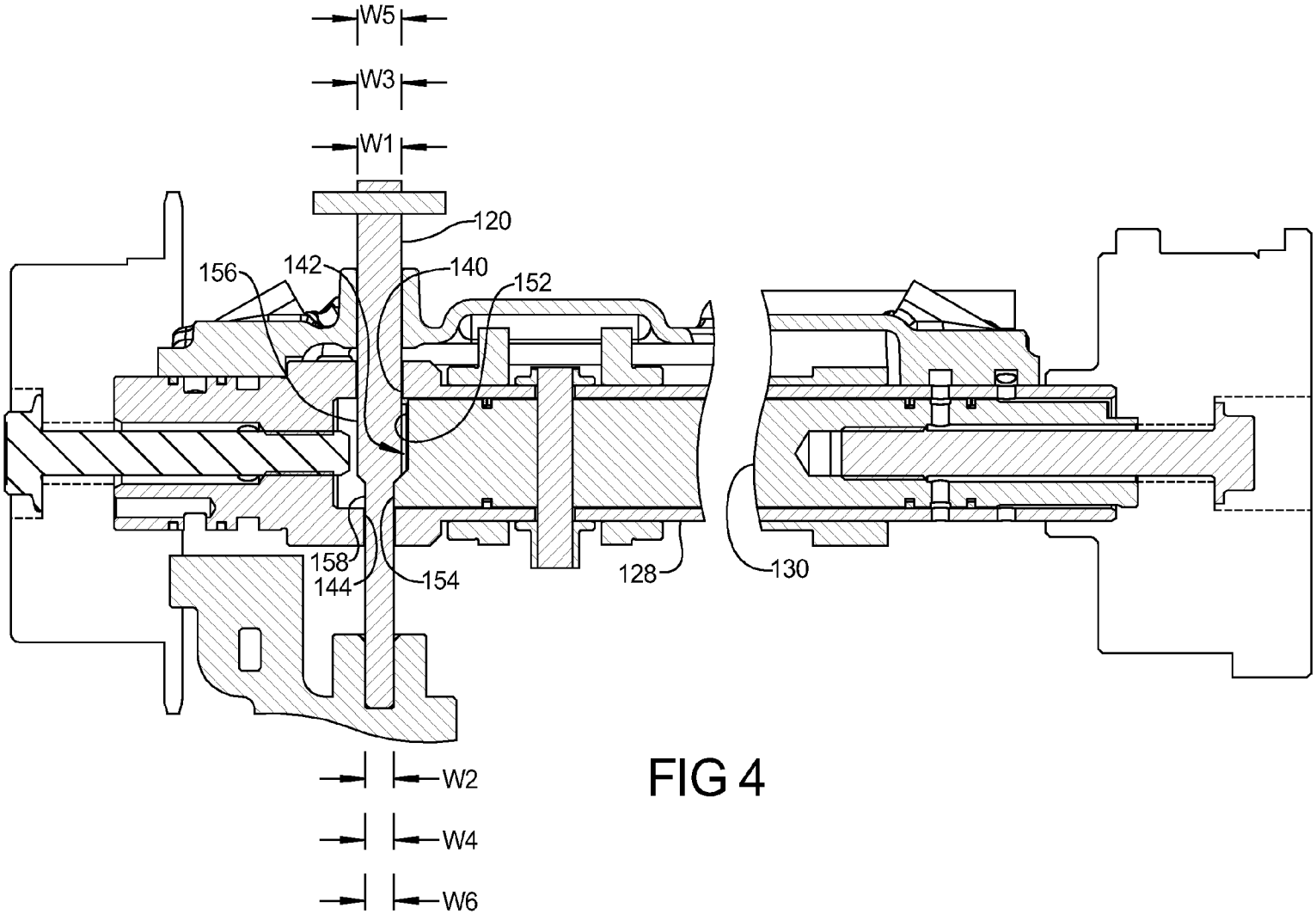
FIG. 4 is a fragmentary section view of an alternate engine assembly according to the present disclosure.

In an alternate arrangement shown in FIG. 4, the first opening 140 in the first shaft 128 may define a first width (W1) greater than a second width (W2) defined by the third opening 144. The second opening 142 in the second shaft 130 may define a first portion 152 adjacent to the first opening 140 and a second portion 154 adjacent to the third opening 144. The first portion 152 may define a third width (W3) greater than a fourth width (W4) defined by the second portion 154. The first and third widths (W1, W3) may be similar to one another and the second and fourth widths (W2, W4) may be similar to one another.

The locating pin 120 may include a first region 156 located in the first opening 140 and the first portion 152 of the second opening 142 and a second region 158 located in the second portion 154 of the second opening 142 and the third opening 144. The first region 156 may define a fifth width (W5) greater than a sixth width (W6) defined by the second region 158. The fifth width (W5) may be similar to the first and third widths (W1, W3) and the sixth width (W6) may be similar to the second and fourth widths (W2, W4). By way of non-limiting example, the widths (W1, W2, W3, W4, W5, W6) may define diameters. However, the locating pin 20, 120 is not limited to having a circular cross-section.

Figure 5:
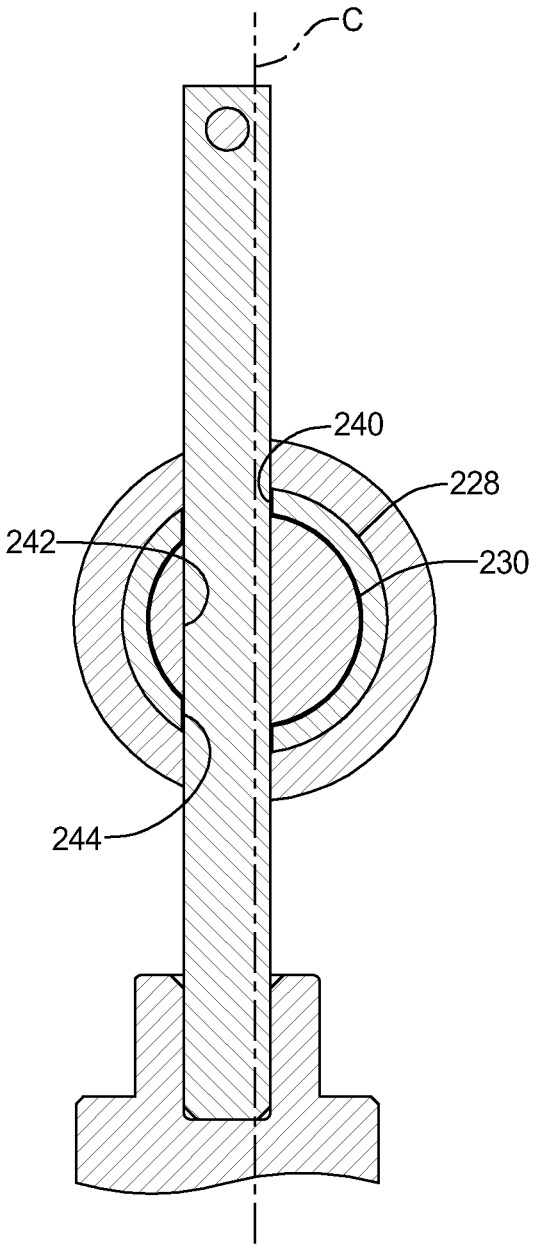
FIG. 5 is a fragmentary section view of another alternate engine assembly according to the present disclosure.

In another alternate arrangement shown in FIG. 5, the longitudinal centers of the first, second and third openings 240, 242, 244 may be radially offset from a diametrical center (C) of the first and second shafts 228, 230. The additional features included in FIGS. 4 and 5 provide for a predetermined rotational orientation of the first shaft 128, 228 relative to the second shaft 130, 230 (i.e., prevents the first shaft 128, 228 from being rotationally offset from the second shaft 130, 230 by one hundred and eighty degrees relative to a desired position).

What is claimed is:

1. An engine assembly comprising:

an engine structure;

a camshaft supported on the engine structure and including:

a first shaft including an annular wall defining an axial bore and a first opening extending through the annular wall and intersecting the axial bore;

a second shaft supported for rotation within the first shaft and defining a second opening;

a first cam lobe located on and fixed for rotation with the first shaft; and a second cam lobe located on the first shaft and fixed for rotation with the second shaft;

a first cam phaser coupled to a first axial end of the camshaft;

a locating pin extending through the first and second openings during assembly and rotationally fixing the first shaft relative to the second shaft;

wherein the first opening extends radially through the first shaft and the second opening extends radially through the second shaft and is rotationally aligned with the first opening during assembly; and wherein the first shaft defines a third opening opposite the first opening, the first opening defining a first width greater than a second width defined by the third opening, the second opening in the second shaft defining a first portion adjacent to the first opening and a second portion adjacent to the third opening, the first portion defining a third width greater than a fourth width defined by the second portion, and the locating pin including a first region located in the first opening and the first portion of the second opening and a second region located in the second portion of the second opening and the third opening, the first region defining a fifth width greater than a sixth width defined by the second region.

2. A method comprising:

locating a first cam phaser on a first axial end of a camshaft, the camshaft including a first shaft having an annular wall defining an axial bore and a first opening extending through the annular wall and intersecting the axial bore, a second shaft supported for rotation within the first shaft and defining a second opening, a first cam lobe located on and fixed for rotation with the first shaft, and a second cam lobe located on the first shaft and fixed for rotation with the second shaft;

inserting a locating pin through the first and second openings and rotationally fixing the first shaft relative to the second shaft;

securing the first cam phaser to the camshaft; and wherein the first opening extends radially through the first shaft and the second opening extends radially through the second shaft and is rotationally aligned with the first opening; and wherein the first shaft defines a third opening opposite the first opening, the first opening defining a first width greater than a second width defined by the third opening, the second opening in the second shaft defining a first portion adjacent to the first opening and a second portion adjacent to the third opening, the first portion defining a third width greater than a fourth width defined by the second portion, and the locating pin including a first region located in the first opening and the first portion of the second opening and a second region located in the second portion of the second opening and the third opening, the first region defining a fifth width greater than a sixth width defined by the second region.

* * * * *